United States Patent [19]

Jeschke

[11] 4,004,512

[45] Jan. 25, 1977

[54] SHEET TRANSFER DRUM FOR PRINTING PRESSES

[75] Inventor: Willi Jeschke, Heidelberg, Germany

[73] Assignee: Heidelberger Druckmaschinen Aktiengesellschaft, Heidelberg, Germany

[22] Filed: Nov. 13, 1975

[21] Appl. No.: 631,678

[30] Foreign Application Priority Data

May 10, 1975 Germany ..... 7515047[U]

[52] U.S. Cl. ..... 101/410; 270/60

[51] Int. Cl.[2] ..... B41F 1/30

[58] Field of Search ..... 101/409–412, 101/246, 415.1; 270/71–76, 60, 47, 38, 19; 271/82, 277

[56] References Cited

UNITED STATES PATENTS 3,643,598 2/1972 Papa ..... 271/277

*Primary Examiner*—Clifford D. Crowder
*Assistant Examiner*—A. Heinz
*Attorney, Agent, or Firm*—Herbert L. Lerner

[57] ABSTRACT

Sheet transfer drum for a printing press includes a shaft, a drum body fixed to the shaft, the drum body including a tube segment having two longitudinal edges, and respective guide rings fixed to both ends of the tube segment, the longitudinal edges of the tube segment defining a gap therebetween a gripper assembly is received in the gap and includes a gripper shaft, a row of grippers fixed to the gripper shaft and a vertically adjustable gripper bearing bar cooperating with the row of grippers for gripping a sheet to be transferred by the sheet transfer drum. A bearing is received in the gap for securing the gripper assembly to the shaft. The guide rings are formed with respective slots extending in peripheral direction of the drum body, and threaded fasteners respectively extend through the slots and releasably secure the guide rings to the shaft within the range of the slots.

3 Claims, 2 Drawing Figures

SHEET TRANSFER DRUM FOR PRINTING PRESSES

Figure 1:
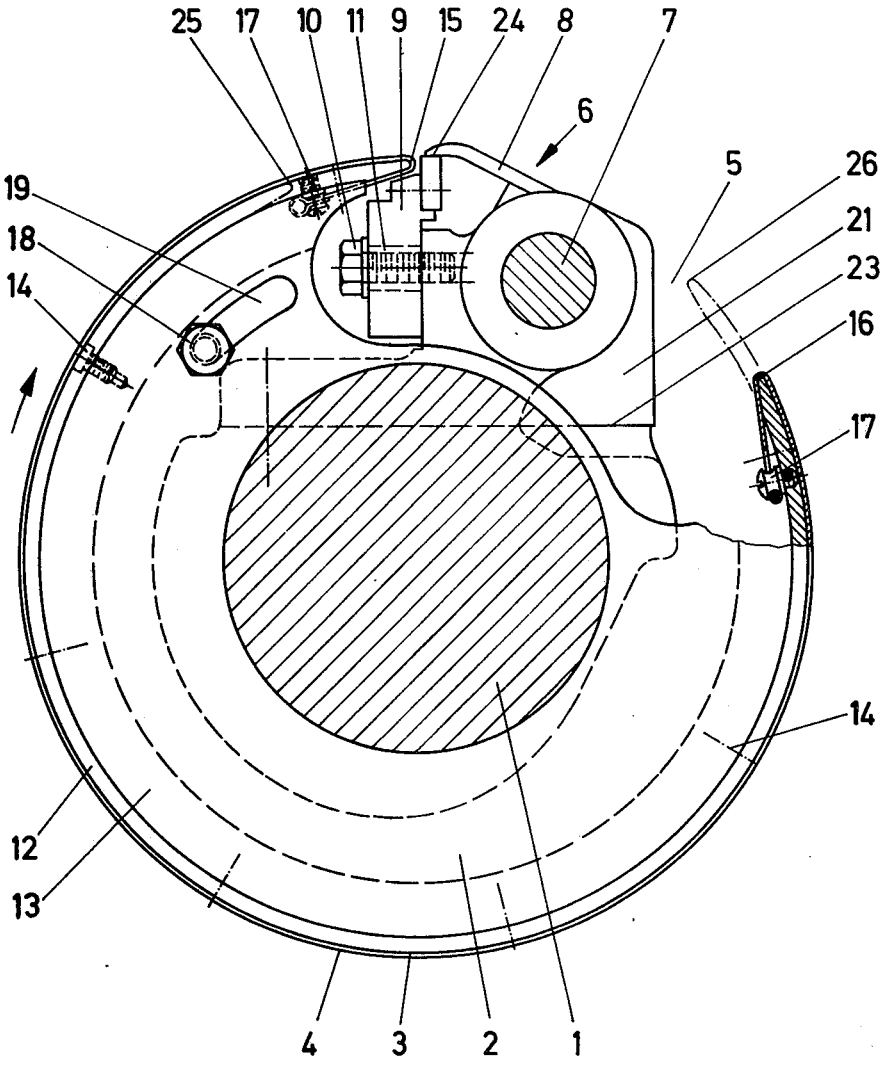

The invention of the instant application relates to a sheet transfer drum for printing presses wherein a drum body is fixed on a shaft, and is formed with a gap for receiving therein a gripper assembly comprising a row of grippers fixed on a gripper shaft and a vertically adjustable gripper bearing bar. A blanket may be clamped onto the jacket of the drum body.

A sheet transfer drum for modern high-speed machines must be capable of faultlessly transfering sheets having varying paper thicknesses with the gripper mechanism thereof and must not smear the printed image on previously printed sheets. For that purpose it has been known heretofore to adjust the height of the gripper bearing bar by loosening screwed connections in accordance with the thickness of the sheets being processed. This is a simple and dependable method which fully satisfies present-day requirements. Another known construction, according to German Patent 2,011,737, employs a gripper bearing bar with a plurality of gripper bearing surfaces of varying heights which are brought into operative position by being rotated. This somewhat more costly construction also permits adjustment of the gripper bearing bar in accordance with the thickness of the material being processed.

To prevent set-off or mackling of the previously printed sheet during the transfer process, the jacket of the sheet transfer drum may be covered with a clamped-on, blanket, the surface of which is ink-repellant so that soiling or damaging of the printed image is avoided.

The heretofore known constructions have the disadvantage that in order to adjust the gripper bearing bar, it is necessary to have a relatively large space between the bearing bar and the jacket of the sheet transfer drum, no support for the sheet being provided, therefore, within that large space.

This gives rise especially to the danger of ink being deposited, for example, on the trailing edge of the clamped-on blanket and smearing the printed image.

It is accordingly an object of the invention to provide a sheet transfer drum for printing presses wherein the bearing surface for the sheets is brought right up to the gripper bearing bar without thereby hampering vertical adjustment of the gripper bearing bar or in fact rendering it impossible.

With the foregoing and other objects in view, there is provided in accordance with the invention, a sheet transfer drum for a printing press comprising a shaft, a drum body fixed to the shaft, the drum body comprising a tube segment having two longitudinal edges and respective guide rings fixed to both ends of the tube segment, the longitudinal edges of the tube segment defining a gap therebetween, a gripper assembly received in the gap and comprising gripper shaft means, a row of grippers fixed to the gripper shaft means and a vertically adjustable gripper bearing bar cooperating with the row of grippers for gripping a sheet to be transfered by the sheet transfer drum, bearing means received in the gap for securing the gripper assembly to the shaft, the guide rings being formed with respective slots extending in peripheral direction of the drum body, and threaded fasteners respectively extending through the slots and releasably securing the guide rings to the shaft, the guide rings being swingably adjustable relative to the shaft within the range of the slots. This construction makes it possible to swing the drum body away a given distance from the gripper bearing bar if an adjustment of the latter is necessary.

In order to provide the narrowest possible gap between the gripper bearing bar and the drum body, according to another feature of the invention, the gripper bearing bar has a gripper bearing surface, the sheet to be transfered being gripped between the gripper bearing surface and the grippers, and the guide rings are swingably adjustable to a position wherein one of the longitudinal edges of the tube segment overlies the gripper bearing bar nearly to the gripper bearing surface.

In accordance with a further feature of the invention, the sheet transfer drum includes blanket means, and means for clamping the blanket means on the tube segment.

With the foregoing preferred embodiment of the invention, the risk of damage to the printed image is avoided in a relatively simple manner, especially for perfecting machines i.e. presses which print on both sides of a sheet.

Other features which are considered as characteristic for the invention are set forth in the appended claims.

Although the invention is illustrated and described herein as embodied in sheet transfer drum for printing presses, it is nevertheless not intended to be limited to the details shown, since various modifications and structural changes may be made therein without departing from the spirit of the invention and within the scope and range of equivalents of the claims.

Figure 2:
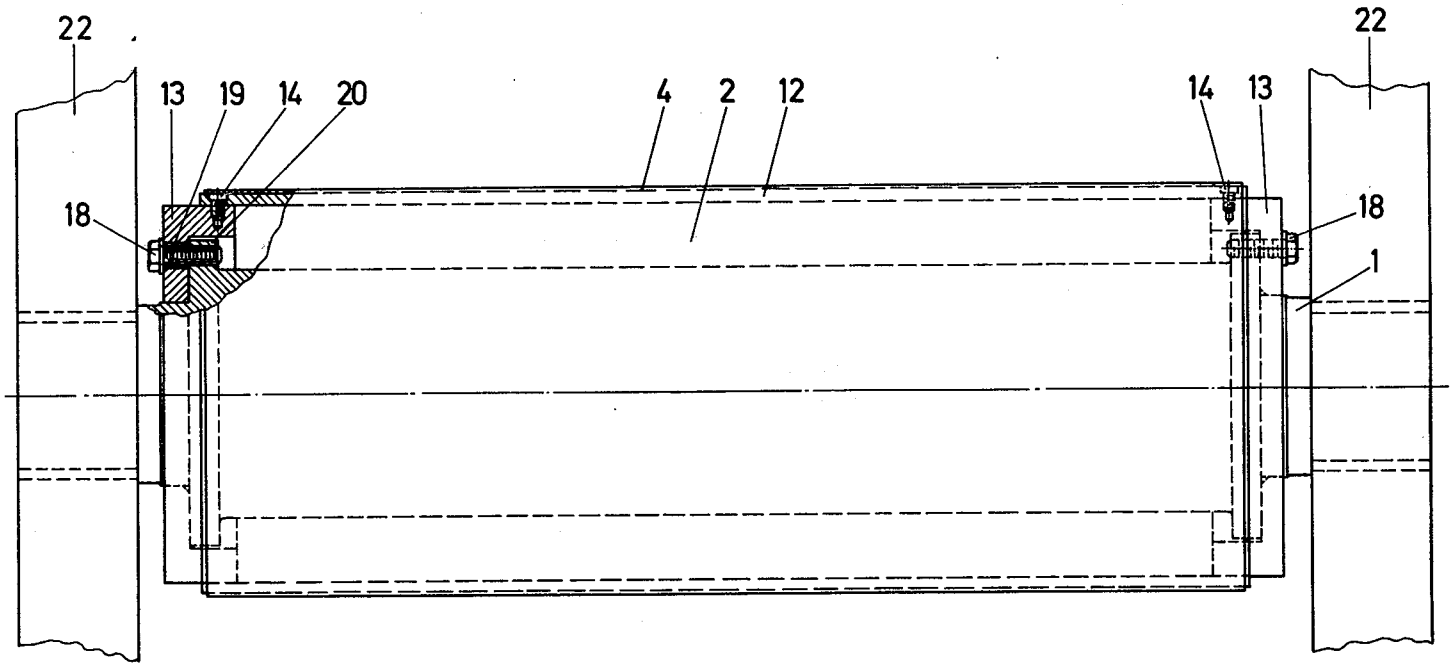

The construction and method of operation of the invention, however, together with additional objects and advantages thereof will be best understood from the following description of specific embodiments when read in connection with the accompanying drawings, in which:

FIG. 1 is a side elevational view, partly in section, of a sheet transfer drum constructed in accordance with the invention; and FIG. 2 is a plan view of the sheet transfer drum, shown at a smaller scale than that of FIG. 1.

Referring now to the drawing and first, particularly, to FIG. 1 thereof, there is shown a sheet transfer drum having a shaft or axle 1 on which a drum body 2 is fastened, the jacket 3 of the drum body 2 being covered by a clamped-on blanket 4 of rubber, fore example. A gripper assembly 6 is provided in the gap 5 formed in the jacket 3 and includes a row of grippers 8 fixed on a gripper shaft 7, and a vertically adjustable gripper bearing bar 9. Adjustment of the latter is effected by loosening screws 10 and suitably shifting the gripper bearing bar 9 within the slots 11.

The drum body 2 is made up of a tube segment 12 and guide rings 13 secured to both ends thereof with screws 14 (FIG. 2). The gap 5 is defined by two longitudinal edges 15 and 16 of the tube segment 12. The clamped-on blanket 4 extends around the longitudinal edges 15 and 16 and fastened to the tube segment 12 by means of pins 17.

The guide rings 13 are threadedly fastenable to the shaft 1 by means of screws 18 and are swingably adjustable relative to the shaft 1 wherein the range of the slots 19. In this illustrated embodiment, the guide rings 13 on both sides engage with a collar 20 formed on the shaft 1 (FIG. 2).

The gripper assembly 6 is secured within the gap 5 to the shaft 1 through bearings 21. The shaft 1, in turn, is mounted in side frames 22 of the printing press in a conventional manner. The bearings 21 are secured on a surface 23 provided for that purpose on the shaft 1.

In the position of the tube segment 12 shown in solid lines in FIG. 1, the tube segment 12 overlies the gripper bearing bars 9 with the longitudinal edge 15 of the tube segment 12 extending nearly up to the gripper bearing surface 24. If it is necessary to loosen the screws 10 in order to adjust the gripper bearing bar 9, the drum body 2 is then rotated in the illustrated embodiment, in countereclockwise direction as viewed in FIG. 1, after the screws 18 have been loosened, until the screws 18 come into engagement with the opposite end of the slots 19. The longitudinal edges 15, 16 of the tube segment 12 are then in the phantom position 25, 26 thereof shown in FIG. 1. After the drum body 2 has thus been turned, the screws 10 are readily accessible so that the gripper bearing bar 9 can be easily adjusted in height. After the gripper bearing bar 9 has been set, the drum body 2 is swung back to the initial position thereof wherein the longitudinal edges 15 and 16 are shown in solid lines, and the screws 18 are tightened.

There is claimed:

1. Sheet transfer drum for a printing press comprising a shaft, a drum body fixed to said shaft, said drum body comprising a tube segment having two ends and two longitudinal edges and respective guide rings fixed to both ends of said tube segment, said longitudinal edges of said tube segment defining a gap therebetween, a gripper assembly received in said gap and comprising, a row of grippers, gripper shaft means for carrying said row of grippers affixed thereto, and a vertically adjustable gripper bearing bar cooperating with said row of grippers for gripping a sheet to be transferred by the sheet transfer drum, bearing means received in said gap for securing said gripper assembly to said shaft, and said guide rings being formed with respective slots extending in peripheral direction of said drum body, and threaded fasteners respectively extending through said slots and releasably securing said guide rings to said shaft, said guide rings being swingably adjustable relative to said shaft within the range of said slots.

2. Sheet transfer drum according to claim 1 wherein said gripper bearing bar has a gripper bearing surface, the sheet to be transferred being gripped between said gripper bearing surface and said grippers, and said guide rings are swingably adjustable to a position wherein one of said longitudinal edges of said tube segment overlies said gripper bearing bar nearly to said gripper bearing surface.

3. Sheet transfer drum according to claim 1 including blanket means for covering said tube segment, and means for clamping said blanket means on said tube segment.

* * * * *